US010294094B2

(12) United States Patent
Mottaz et al.

(10) Patent No.: US 10,294,094 B2
(45) Date of Patent: May 21, 2019

(54) CONTAINERS HAVING ONE OR MORE SLOPED INNER REGIONS FOR PROVIDING AN IMPROVED ABILITY FOR DISPENSING LIQUIDS

(71) Applicant: SHOMO, LLC, London Mills, IL (US)

(72) Inventors: Curt Daniel Mottaz, Farmington, IL (US); Ernest Gordon Shortness, London Mills, IL (US)

(73) Assignee: SHOMO, LLC, London Mills, IL (US)

( * ) Notice: Subject to any disclaimer, the term of this patent is extended or adjusted under 35 U.S.C. 154(b) by 287 days.

(21) Appl. No.: 14/680,800

(22) Filed: Apr. 7, 2015

(65) Prior Publication Data

US 2016/0297667 A1 Oct. 13, 2016

(51) Int. Cl.

| | |
|---|---|
| ***B67D 3/00*** | (2006.01) |
| ***B65D 25/42*** | (2006.01) |
| ***B65D 81/38*** | (2006.01) |
| ***B65D 25/28*** | (2006.01) |
| ***B65D 85/72*** | (2006.01) |
| ***B65D 25/38*** | (2006.01) |

(52) U.S. Cl.

CPC ..... *B67D 3/0067* (2013.01); *B65D 25/2888* (2013.01); *B65D 25/38* (2013.01); *B65D 25/42* (2013.01); *B65D 81/3802* (2013.01); *B65D 85/72* (2013.01); *B67D 3/0083* (2013.01); *B67D 2210/0016* (2013.01)

(58) Field of Classification Search

CPC ..... B67D 3/0067; B65D 25/42; B65D 73/02; B65D 85/72

USPC ..... 222/185.1

See application file for complete search history.

(56) References Cited

U.S. PATENT DOCUMENTS

| | | | | | |
|---|---|---|---|---|---|
| 581,085 | A | * | 4/1897 | Ruppert | 62/396 |
| 2,510,671 | A | * | 6/1950 | Verheyden | 220/592.18 |
| 3,319,834 | A | * | 5/1967 | Steele | 222/146.2 |
| 3,368,721 | A | * | 2/1968 | Wiskochil | 222/183 |
| 3,776,435 | A | * | 12/1973 | Smith | 222/566 |
| 3,837,533 | A | * | 9/1974 | Splan | 222/94 |
| 4,398,653 | A | * | 8/1983 | Daloisio | 222/143 |
| 4,721,214 | A | * | 1/1988 | Wandel | A47G 19/127 215/13.1 |
| 4,847,028 | A | * | 7/1989 | Snyder et al. | 264/155 |
| 5,024,346 | A | * | 6/1991 | Roser | 220/9.1 |
| 5,148,939 | A | * | 9/1992 | Roser | 220/9.4 |

(Continued)

OTHER PUBLICATIONS

*Never Tilt Coolers*, www.nevertiltcoolersinchicagoil.com/never-tilt-coolers/, AngleWare, Chicago, IL, 1 page, accessed on Jun. 23, 2015.

(Continued)

*Primary Examiner* — Patrick M. Buechner
*Assistant Examiner* — Michael J. Melaragno
(74) *Attorney, Agent, or Firm* — Jaffery Watson Mendonsa & Hamilton LLP

(57) ABSTRACT

Described herein is a container for storing and dispensing a liquid. In one embodiment, the container for dispensing a liquid includes an upper region that is capable of being removed from the container, a sidewall region coupled or integrated with the upper region, and a lower region coupled or integrated with the sidewall region. The lower region includes an inner sloped surface within the container to provide an improved ability for dispensing the liquid from the container.

12 Claims, 7 Drawing Sheets

(56) References Cited

U.S. PATENT DOCUMENTS

| | | | | |
|---|---|---|---|---|
| 5,373,961 | A * | 12/1994 | Harris et al. | 220/571 |
| 5,445,289 | A * | 8/1995 | Owen | 222/105 |
| 5,673,823 | A * | 10/1997 | Hanks et al. | 222/185.1 |
| 5,702,034 | A * | 12/1997 | Semenenko | 222/143 |
| 5,971,218 | A * | 10/1999 | Le | 222/185.1 |
| 6,079,587 | A * | 6/2000 | Vogt | 220/571 |
| 6,827,237 | B2 * | 12/2004 | Yorn et al. | 222/105 |
| 7,275,662 | B1 * | 10/2007 | Milcetich | 222/185.1 |
| 7,849,892 | B1 * | 12/2010 | Connors et al. | 141/356 |
| 8,448,564 | B2 * | 5/2013 | Hart | 99/275 |
| 8,567,627 | B2 * | 10/2013 | Schmider | 220/4.12 |
| 2002/0107492 | A1 | 8/2002 | Brach et al. | |
| 2003/0034359 | A1 * | 2/2003 | Lassota | 222/185.1 |
| 2003/0034360 | A1 * | 2/2003 | Lassota et al. | 222/185.1 |
| 2003/0089742 | A1 * | 5/2003 | Fons | 222/185.1 |
| 2003/0094465 | A1 * | 5/2003 | Ellis | 222/185.1 |
| 2003/0141316 | A1 | 7/2003 | Griese et al. | |
| 2003/0222089 | A1 | 12/2003 | Hale | |
| 2004/0069808 | A1 * | 4/2004 | Blain | 222/185.1 |
| 2004/0182949 | A1 | 9/2004 | Duston et al. | |
| 2005/0006386 | A1 | 1/2005 | von Ronn et al. | |
| 2005/0028550 | A1 | 2/2005 | Crette | |
| 2005/0029263 | A1 | 2/2005 | von Ronn et al. | |
| 2006/0065679 | A1 * | 3/2006 | Gregory | 222/482 |
| 2006/0185764 | A1 | 8/2006 | Bronner | |
| 2006/0186218 | A1 | 8/2006 | Duston et al. | |
| 2006/0243745 | A1 * | 11/2006 | Doneghue et al. | 222/185.1 |
| 2006/0261088 | A1 * | 11/2006 | Chin | 222/131 |
| 2007/0045339 | A1 | 3/2007 | Manion et al. | |
| 2008/0041882 | A1 | 2/2008 | Lips | |
| 2008/0047979 | A1 * | 2/2008 | Lee | 222/185.1 |
| 2008/0110904 | A1 | 5/2008 | Smith | |
| 2008/0156827 | A1 * | 7/2008 | Alberto Rodrigues Anjos | 222/105 |
| 2009/0230153 | A1 | 9/2009 | Knight et al. | |
| 2009/0236369 | A1 * | 9/2009 | Lin | 222/185.1 |
| 2009/0294486 | A1 * | 12/2009 | McKnight et al. | 222/482 |
| 2010/0108779 | A1 | 5/2010 | Filsouf | |
| 2010/0111732 | A1 | 5/2010 | Ciavarella et al. | |
| 2011/0266287 | A1 | 11/2011 | Groesbeck et al. | |
| 2012/0085461 | A1 | 4/2012 | Coker et al. | |
| 2012/0193362 | A1 | 8/2012 | Porter et al. | |
| 2012/0318824 | A1 * | 12/2012 | McKenna | 222/185.1 |
| 2013/0306669 | A1 | 11/2013 | Ray | |
| 2014/0175126 | A1 * | 6/2014 | Carlsson et al. | 222/145.5 |
| 2014/0231458 | A1 | 8/2014 | Barclay | |
| 2014/0291356 | A1 * | 10/2014 | Schutz | 222/183 |
| 2014/0318533 | A1 | 10/2014 | Patton et al. | |
| 2015/0122844 | A1 * | 5/2015 | Klein et al. | 222/185.1 |

OTHER PUBLICATIONS

Notification Concerning Transmittal of International Preliminary Report on Patentability, PCT/US2016/025071, dated Oct. 19, 2017, 12 pages.

* cited by examiner

CONTAINERS HAVING ONE OR MORE SLOPED INNER REGIONS FOR PROVIDING AN IMPROVED ABILITY FOR DISPENSING LIQUIDS

TECHNICAL FIELD

Embodiments of the present invention relate to containers having inner sloped regions for dispensing liquids.

BACKGROUND

Containers (e.g., water coolers) for dispensing liquids can store and dispense liquids with a faucet assembly. However, the liquids may be difficult to dispense from the container if a limited volume or a low level of a liquid is in the container.

BRIEF DESCRIPTION OF THE DRAWINGS

The present invention is illustrated by way of example, and not by way of limitation, in the figures of the accompanying drawings and in which.

DETAILED DESCRIPTION

Figure 1:
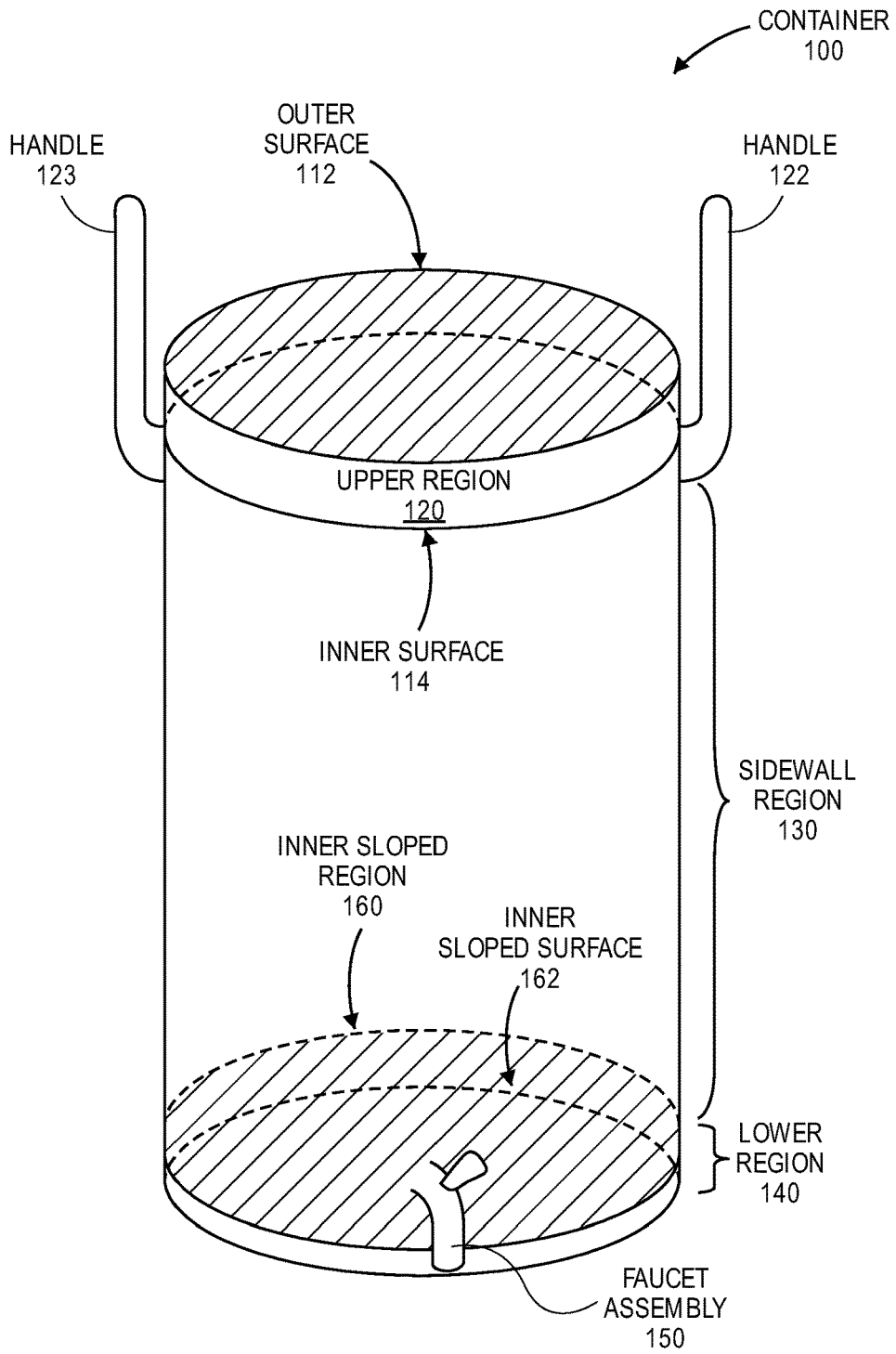
FIG. 1 illustrates a container having a lower region with a sloped inner region to provide an improved ability for dispensing a liquid in accordance with one embodiment.

Described herein are containers (e.g., beverage containers, liquid containers, coolers, water coolers) for storing and dispensing a liquid. In one embodiment, a container for dispensing a liquid (or semiliquid mixture, slurry, any fluid mixture of a pulverized solid with a liquid, fluid mixture of liquid and ice, etc.) includes an upper region that is capable of being removed from the container, a sidewall region coupled or integrated with the upper region, and a lower region coupled or integrated with the sidewall region. The lower region includes an inner sloped region within the container to provide an improved ability for dispensing the liquid from the container even with low levels of liquid within the container.

For example, a user of a container may have difficulty in dispensing a low level of liquid from the container. The user may tilt the container to obtain the liquid which can cause the container to spill or fall over.

The one or more inner sloped regions of the containers discussed herein prevent liquid, even low levels of liquids (e.g., a container having a low level of liquid less than 10 percent of a full liquid capacity, semiliquid mixture, slurry, or any fluid mixture of a pulverized solid with a liquid) from remaining in containers. The container provides convenience with no need to tip the container to obtain the last portion or drop of a liquid (or semiliquid mixture, slurry, or any fluid mixture of a solid with a liquid) from the container. The container provides improved safety especially for hot liquids (e.g., coffee, hot chocolate, etc.) in that tipping standard containers can be hazardous when the container slips off a support surface (e.g., table, countertop). A container with one or more inner sloped regions also provides ease of use because tipping standard flat bottom containers requires a second person to tip the jug while another person operates the dispensing mechanism (e.g., pushes a button or turns a valve, etc.) with one hand and holds a cup with the other hand. With this novel technology, one person is all that is needed to dispense all liquid (or semiliquid mixture, slurry, or any fluid mixture of a pulverized solid with a liquid) from the container. Depending on the location, it may not be easy to tip a standard cooler. Coolers at construction sites or on service trucks may be restricted from tipping by protective railing or other restraints that secure the container for transport or for safety reasons. This technology allows full use of all the contents within the container without the need for tipping.

Concession operators will appreciate efficiency of this technology as the full contents of the cooler can be more easily utilized. Standard flat bottom coolers are best placed on a flat surface. If a standard cooler is placed where it may be tipping even slightly backwards, then even more liquid is retained from free flow and tipping the container becomes even more necessary. With this improved technology, the flow of the liquid (or semiliquid mixture, slurry, or any fluid mixture of a pulverized solid with a liquid) continues even with a slight backwards tipping. Only a major angle tipping backwards would impede the flow or retain contents of the cooler with this technology. This technology is adaptable to a wide range of use across a wide variety and types of containers.

In this manner, the containers are not spilled and the liquid (or semiliquid mixture, slurry, or any fluid mixture of a pulverized solid with a liquid) is not wasted or left in the container. A container is any type of device that forms a partially or fully enclosed space for containing, storing, transporting, or dispensing materials such as liquids.

In the following description, numerous details are set forth. It will be apparent, however, to one skilled in the art, that the present invention may be practiced without these specific details. In some instances, well-known structures and devices are shown in block diagram form, rather than in detail, in order to avoid obscuring the present invention.

FIG. 1 illustrates a container having a lower region with a sloped inner region to provide an improved ability for dispensing a liquid (or semiliquid mixture, slurry, or any fluid mixture of a pulverized solid with a liquid) in accordance with one embodiment. The container may be used for storing, insulating, cooling, and dispensing one or more liquids. The container 100 for dispensing a liquid includes an upper region 120 having an outer surface 112 and an inner surface 114. A sidewall region 130 is integrated or coupled in a removable manner with the upper region 120. The upper region 120 may include or be a pull off pressure fit lid. Alternatively, the upper region 120 may include or be a twist off lid that is removable by rotating the lid. A lower region 140 (e.g., base region) is integrated or coupled in a removable manner with the sidewall region. In one example, the lower region 140 is not removable, it is integrated with the sidewall region. The lower region 140 includes an inner sloped region 160 having an inner sloped surface 162 within the container for improving an ability of the container to dispense the liquid from the container. The inner sloped surface 162 is an upper surface of the inner sloped region 160.

A faucet assembly 150 (e.g., spigot, dispenser) is integrated with or coupled with an opening of the lower region or an opening of the sidewall region to dispense the liquid outside of the container. The faucet assembly 150 includes a closed position for sealing a liquid in the container and also an open position for allowing liquid to be dispensed from the container. The inner sloped surface 162 of the container provides a tip free technology that prevents the liquid (e.g., low level of liquid) from being trapped inside the container even when the faucet assembly is in an open position and the lower region rests on a surface (e.g., horizontal surface) without being tilted. In one example, the inner sloped surface has a slope sufficient (e.g., 3 to 30 degrees, 5 to 15 degrees, 8 to 12 degrees, 10 degrees) with respect to a horizontal reference line to drain liquid from inside of the container. The container (e.g., upper region, sidewall region, lower region) may include insulation (e.g., polyurethane insulation) for keeping ice or liquid at a lower temperature in the container in comparison to ambient temperature conditions. In one example, the container does not include any type of pumping mechanism for pumping liquid out of the container. The container only includes one or more inner sloped regions and a faucet assembly for dispensing liquid from the container.

In one embodiment, the inner sloped surface has a downward slope towards the faucet assembly. The inner sloped region 160 has a variable thickness that gradually decreases in thickness near the faucet assembly or as the inner sloped region 160 approaches the faucet assembly.

In one example, the inner sloped surface of the inner sloped region includes at least one groove or channel (e.g., V-shaped, U-shaped) for directing the liquid inside the container towards the faucet assembly even if a small volume or low level of liquid (or semiliquid mixture, slurry, or any fluid mixture of a pulverized solid with a liquid) remains in the container.

The container may have a cylindrical shape with the lower region supporting the sidewall region and the upper region as illustrated in FIG. 1. In one specific example, the container (e.g., 3-10 gallon) has a height of 12-24 inches and a diameter of 8-14 inches. Alternatively, the container may have any type of shape such as a rectangular shape, square shape, triangular shape, one quarter cylindrical shape, etc. and any size with the lower region supporting the sidewall region and the upper region.

Figure 2:
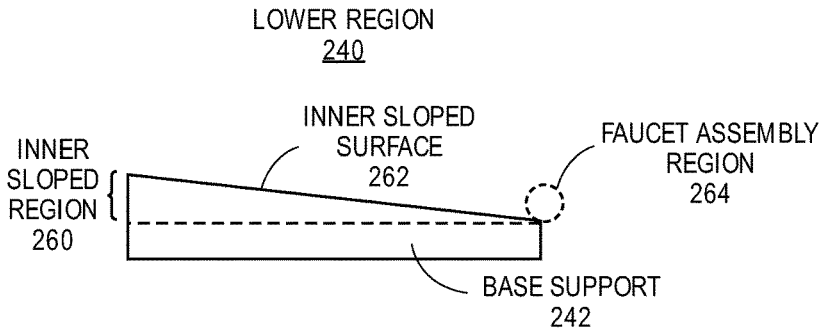
FIG. 2 illustrates a cross-sectional view of a sloped lower region of a container in accordance with one embodiment.

FIG. 2 illustrates a cross-sectional view of a lower region of a container with a sloped inner region to provide an improved ability for dispensing a liquid (or semiliquid mixture, slurry, or any fluid mixture of a pulverized solid with a liquid) in accordance with one embodiment. The container (e.g., liquid cooler, water cooler) may be used for storing, insulating, cooling, and dispensing one or more liquids. A lower region 240 (e.g., base region) is integrated or coupled in a removable manner with a sidewall region of a container. In one example, the lower region 240 is not removable, it is integrated with the sidewall region. The lower region 240 includes an inner sloped region 260 having an inner sloped surface 262 within the container for improving an ability of the container to dispense the liquid (e.g., all liquid) from the container. The inner sloped surface 262 is an upper surface of the inner sloped region 260. The lower region 240 includes a base support 242 for supporting the container. The base support may be a solid or a partial solid (e.g., partial solid with a hollow concave bottom shape). The base support and inner sloped region may include insulation (e.g., polyurethane insulation) for thermal insulating of ice or liquid in the container. The inner sloped surface 262 has a slope sufficient (e.g., 3 to 30 degrees, 5 to 15 degrees, 8 to 12 degrees, 10 degrees) with respect to a horizontal reference line to drain liquid from the container. The inner sloped surface 262 slopes downwards towards a faucet assembly region 264 that indicates a location of the faucet assembly (not shown in FIG. 2) with respect to the inner sloped region 260.

Figure 3:
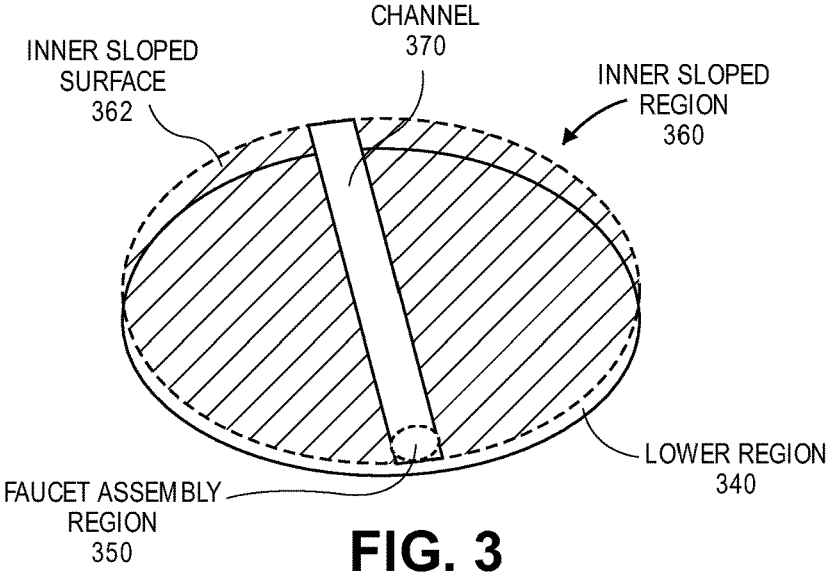
FIG. 3 illustrates a lower region of a container with a sloped inner region to provide an improved ability for dispensing a liquid in accordance with one embodiment.

FIG. 3 illustrates a lower region of a container with a sloped inner region to provide an improved ability for dispensing a liquid (or semiliquid mixture, slurry, or any fluid mixture of a pulverized solid with a liquid) in accordance with one embodiment. The container (e.g., liquid cooler, water cooler) may be used for storing, insulating, cooling, and dispensing one or more liquids. A lower region 340 (e.g., base region) is integrated or coupled in a removable manner with a sidewall region of a container. In one example, the lower region 340 is not removable, it is integrated with the sidewall region. The lower region 340 includes an inner sloped region 360 having an inner sloped surface 362 and an optional recessed channel 370 within the container for improving an ability of the container to dispense the liquid (e.g., all liquid) from the container. The inner sloped surface 362 is an upper surface of the inner sloped region 360. The channel 370 is recessed at a lower level than the inner sloped surface 362. The channel 370 can be a single channel as illustrated in FIG. 3 or the channel can include multiple sub-channels for directing the liquid towards the faucet assembly. The channel or sub-channels can be any length, width, depth, or shape appropriate for dispensing a liquid from the container.

The lower region may include insulation (e.g., polyurethane insulation) for thermal insulating of ice or liquid in the container. The inner sloped surface 362 has a slope sufficient (e.g., 3 to 30 degrees, 5 to 15 degrees, 8 to 12 degrees, 10 degrees) with respect to a horizontal reference line to drain liquid from the lower region of the container. The inner sloped surface 362 slopes downwards towards a faucet assembly region 350 that indicates a location of the faucet assembly (not shown in FIG. 3) with respect to the inner sloped region 360.

Figure 4:
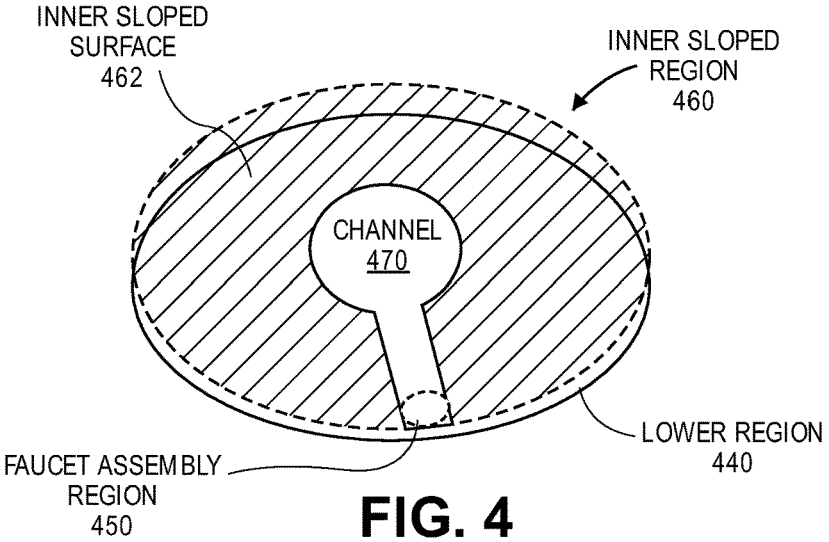
FIG. 4 illustrates a lower region of a container with a sloped inner region to provide an improved ability for dispensing a liquid in accordance with one embodiment.

FIG. 4 illustrates a lower region of a container with a sloped inner region to provide an improved ability for dispensing a liquid (or semiliquid mixture, slurry, or any fluid mixture of a pulverized solid with a liquid) in accordance with one embodiment. The container (e.g., liquid cooler, water cooler) may be used for storing, insulating, cooling, and dispensing one or more liquids. A lower region 440 (e.g., base region) is integrated or coupled in a removable manner with a sidewall region of a container. In one example, the lower region 440 is not removable, it is integrated with the sidewall region. The lower region 440 includes an inner sloped region 460 having an inner sloped surface 462 and an optional recessed channel 470 within the container for improving an ability of the container to dispense the liquid (e.g., all liquid) from the container. The inner sloped surface 462 is an upper surface of the inner sloped region 460. The channel 470 is recessed at a lower level than the inner sloped surface 462. The channel 470 can be a single channel as illustrated in FIG. 4 or the channel can include multiple sub-channels for directing the liquid towards the faucet assembly. The channel can be any length, width, depth, or shape appropriate for dispensing a liquid from the container.

The lower region may include insulation (e.g., polyurethane insulation) for thermal insulating of ice or liquid in the container. The inner sloped surface 462 has a slope sufficient (e.g., 3 to 30 degrees, 5 to 15 degrees, 8 to 12 degrees, 10 degrees) with respect to a horizontal reference line to drain liquid from the container. The inner sloped surface 462 slopes downwards towards a faucet assembly region 450 that indicates a location of the faucet assembly (not shown in FIG. 4) with respect to the inner sloped region 460.

Figure 5:
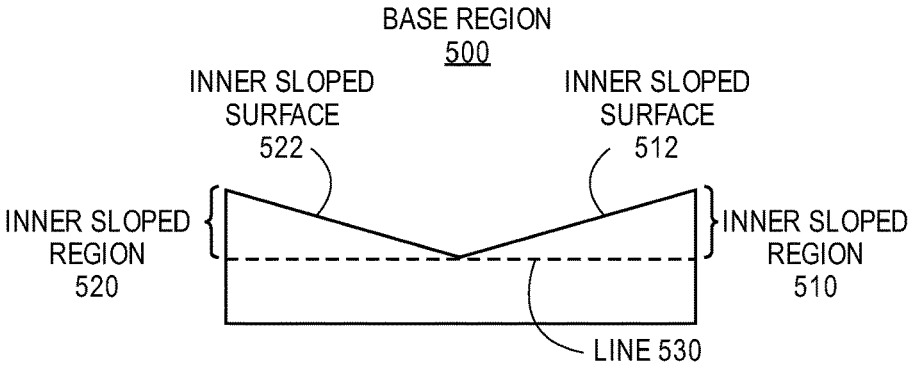
FIG. 5 illustrates a cross-sectional view of a base region of a container with multiple sloped inner regions to provide an improved ability for dispensing a liquid in accordance with one embodiment.

FIG. 5 illustrates a cross-sectional view of a base region of a container with multiple sloped inner regions to provide an improved ability for dispensing a liquid (or semiliquid mixture, slurry, or any fluid mixture of a pulverized solid with a liquid) in accordance with one embodiment. The container (e.g., liquid cooler, water cooler) may be used for storing, insulating, cooling, and dispensing one or more liquids. A base region 500 is integrated or coupled in a removable manner with a sidewall region of a container. In one example, the base region 500 is not removable, it is integrated with the sidewall region. The base region 500 includes an inner sloped region 510 having an inner sloped surface 512 and an inner sloped region 520 having an inner sloped surface 522 within the container for improving an ability of the container to dispense the liquid (e.g., all liquid) from the container. The inner sloped surface 512 is an upper surface of the inner sloped region 510 and the inner sloped surface 522 is an upper surface of the inner sloped region 520.

The base region may include insulation (e.g., polyurethane insulation) for thermal insulating of ice or liquid in the container. The inner sloped surfaces 512 and 522 have a slope sufficient (e.g., 3 to 30 degrees, 5 to 15 degrees, 8 to 12 degrees, 10 degrees) with respect to a reference line 530 to drain liquid from the base region of the container. The inner sloped surfaces slope downwards towards a faucet assembly (not shown).

Figure 6:
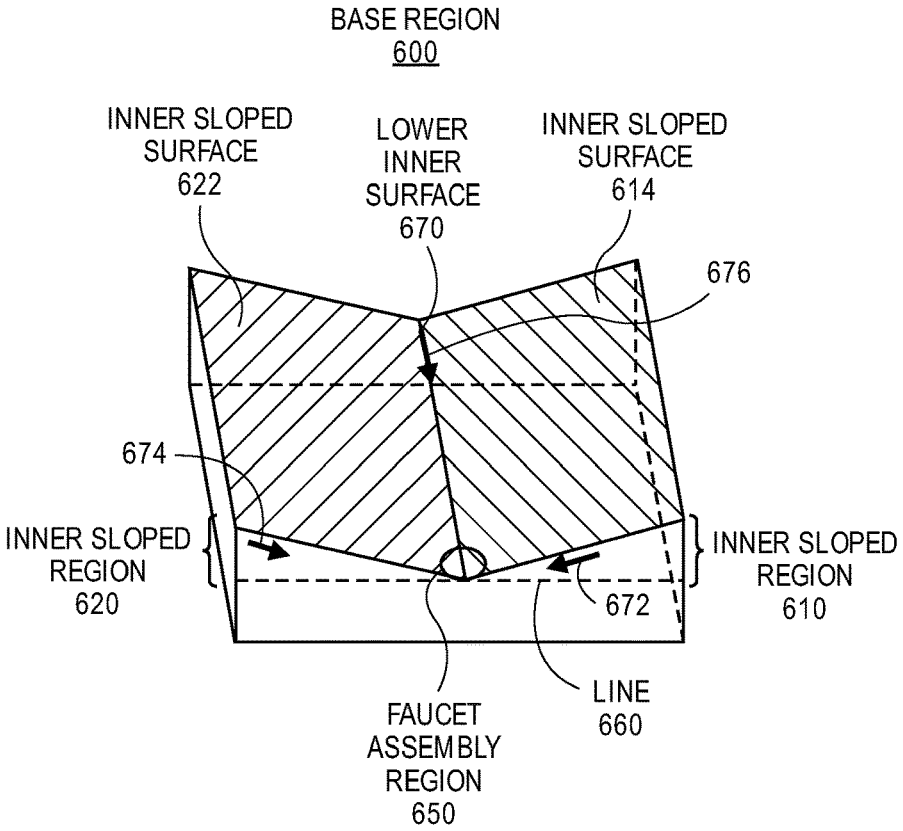
FIG. 6 illustrates a perspective view of a base region of a container with multiple sloped inner regions to provide an improved ability for dispensing a liquid in accordance with one embodiment.

FIG. 6 illustrates a perspective view of a base region of a container with multiple sloped inner regions to provide an improved ability for dispensing a liquid (or semiliquid mixture, slurry, or any fluid mixture of a pulverized solid with a liquid) in accordance with one embodiment. The container (e.g., liquid cooler, water cooler) may be used for storing, insulating, cooling, and dispensing one or more liquids. A base region 600 is integrated or coupled in a removable manner with a sidewall region of a container. In one example, the base region 600 is not removable, it is integrated with the sidewall region. The base region 600 includes an inner sloped region 610 having an inner sloped surface 614 and an inner sloped region 620 having an inner sloped surface 622 within the container for improving an ability of the container to dispense the liquid (e.g., all liquid, semiliquid mixture, slurry, or any fluid mixture of a pulverized solid with a liquid) from the container. The inner sloped surface 614 is an upper surface of the inner sloped region 610 and the inner sloped surface 622 is an upper surface of the inner sloped region 620.

The base region may include insulation (e.g., polyurethane insulation) for thermal insulating of ice or liquid in the container. The inner sloped surfaces 614 and 622 have a slope sufficient (e.g., 3 to 30 degrees, 5 to 15 degrees, 8 to 12 degrees, 10 degrees) with respect to a reference line 660 (e.g., horizontal reference line 660) to drain liquid from the base region of the container. The inner sloped surfaces slope downwards towards a faucet assembly region 650 that indicates a location of the faucet assembly (not shown in FIG. 6) with respect to the inner sloped regions.

In one embodiment, the inner sloped region 610 has a downward slope in a direction 672 towards a lower inner surface 670 of the base region while the inner sloped region 620 has a downward slope in a direction 674 towards the lower inner surface 670 of the base region. The lower inner surface 670 has a downward slope in a direction 676 towards the faucet. The lower inner surface 670 may also include at least one groove or channel with a downward slope in the direction 676 for directing the liquid inside the cooler towards the faucet assembly region 650. The lower inner surface 670 is illustrated as having a minimal width at an intersection of the inner sloped regions 610 and 620. In another example, the lower inner surface 670 is wider (e.g., 0.1 inches to 3 inches) as appropriate for draining a liquid from the container.

Figure 7:
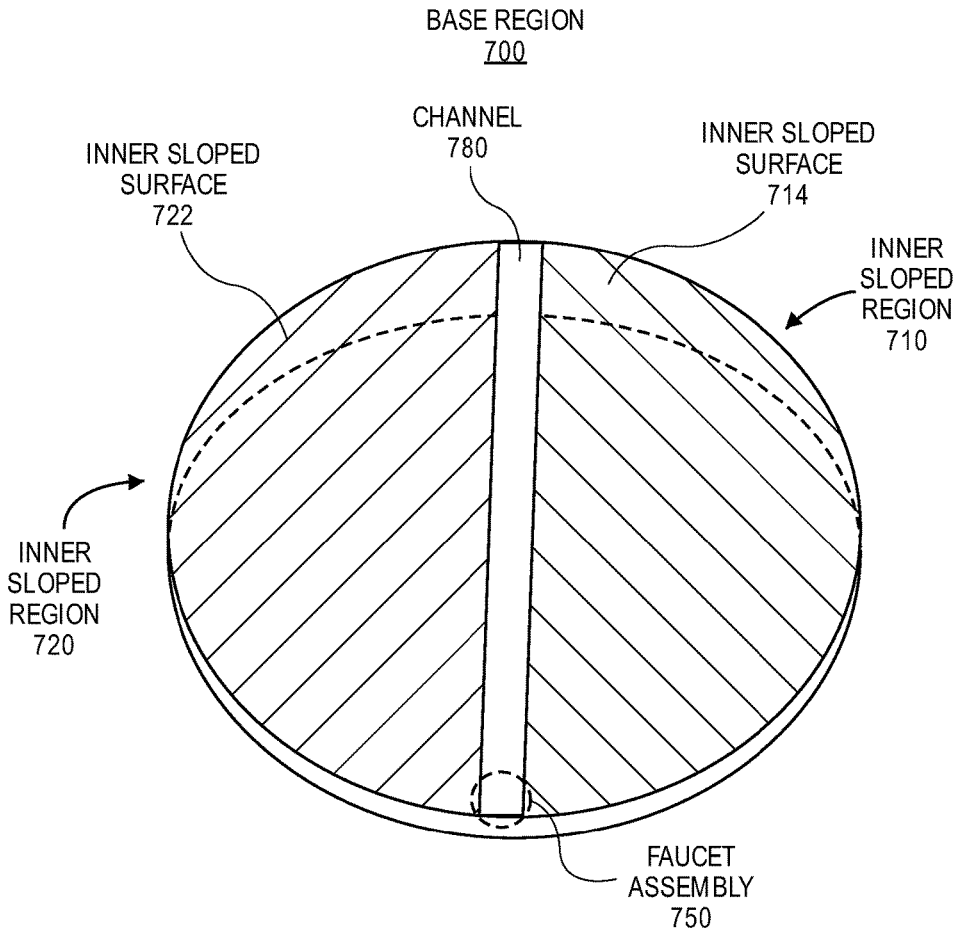
FIG. 7 illustrates a perspective view of a base region of a container with multiple sloped inner regions to provide an improved ability for dispensing a liquid in accordance with one embodiment.

FIG. 7 illustrates a perspective view of a base region of a container with multiple sloped inner regions to provide an improved ability for dispensing a liquid (or semiliquid mixture, slurry, or any fluid mixture of a pulverized solid with a liquid) in accordance with one embodiment. The container (e.g., beverage container, liquid cooler, water cooler) may be used for storing, insulating, cooling, and dispensing one or more liquids. A base region 700 is integrated or coupled in a removable manner with a sidewall region of a container. In one example, the base region 700 is not removable, it is integrated with the sidewall region. The base region 700 includes an inner sloped region 710 having an inner sloped surface 714 and an inner sloped region 720 having an inner sloped surface 722 within the container for improving an ability of the container to dispense the liquid (e.g., all liquid) from the container. The inner sloped surface 714 is an upper surface of the inner sloped region 710 and the inner sloped surface 722 is an upper surface of the inner sloped region 720. The channel 780 is recessed at a lower level than the inner sloped surfaces. The channel 780 can be a single channel as illustrated in FIG. 7 or the channel can include multiple sub-channels for directing the liquid towards the faucet assembly. The channel can be any length, width, depth, or shape appropriate for dispensing a liquid from the container. The channel may also slope downwards towards the faucet assembly 750.

The base region may include insulation (e.g., polyurethane insulation) for thermal insulating of ice or liquid in the container. The inner sloped surfaces 714 and 722 have a slope sufficient (e.g., 3 to 30 degrees, 5 to 15 degrees, 8 to 12 degrees, 10 degrees) with respect to a reference line (e.g., horizontal reference line) to drain liquid from the base region of the container. The inner sloped surfaces slope downwards towards a faucet assembly region 750 that indicates a location of the faucet assembly (not shown in FIG. 7) with respect to the inner sloped regions.

Figure 8:
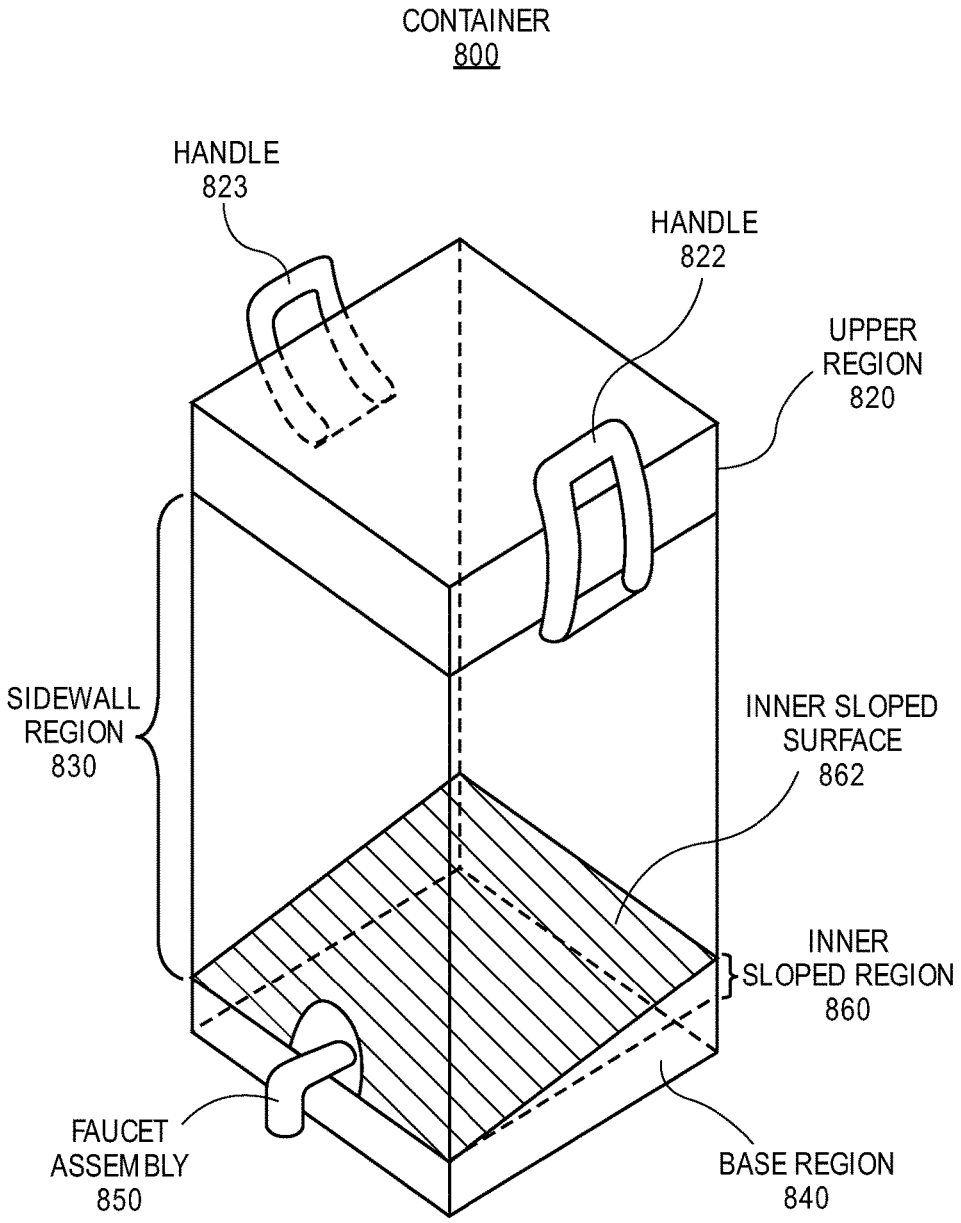
FIG. 8 illustrates a container having a base region with a sloped inner region to provide an improved ability for dispensing a liquid in accordance with one embodiment.

FIG. 8 illustrates a container having a base region with a sloped inner region to provide an improved ability for dispensing a liquid (or semiliquid mixture, slurry, or any fluid mixture of a pulverized solid with a liquid) in accordance with one embodiment. The container may be used for storing, insulating, cooling, and dispensing one or more liquids. The container 800 for dispensing a liquid includes an upper region 820 having an outer surface and an inner surface. A sidewall region 830 is integrated or coupled in a removable manner with the upper region 820. Handles 822 and 823 are attached to the sidewall region 830. The upper region 820 may include or be a pull off pressure fit lid. Alternatively, the upper region 820 may include a pull off pressure fit lid or a twist off lid that is removable by rotating the lid. A base region 840 is integrated or coupled in a removable manner with the sidewall region. In one example, the base region 840 is not removable, it is integrated with the sidewall region. The base region 840 includes an inner sloped region 860 having an inner sloped surface 862 within the container for improving an ability of the container to dispense the liquid from the container. The inner sloped surface 862 is an upper surface of the inner sloped region 860. Alternatively, the sidewall region 830 includes the inner sloped region 860.

A faucet assembly 850 (e.g., spigot, dispenser) is integrated with or coupled with an opening of the base region or an opening of the sidewall region to dispense the liquid outside of the container. The inner sloped surface 862 of the container provides a tip free technology that prevents the liquid (e.g., low level of liquid) from being trapped inside the container even when the faucet assembly is in an open position and the base region rests on a surface (e.g., horizontal surface) without being tilted. In one example, the inner sloped surface has a slope sufficient (e.g., 3 to 30 degrees, 5 to 15 degrees, 8 to 12 degrees, 10 degrees) with respect to a horizontal reference line to drain liquid from the base region of the container. The container (e.g., upper region, sidewall region, lower region) may include insulation (e.g., polyurethane insulation) for keeping ice or liquid at a lower temperature in the container in comparison to ambient temperature conditions.

In one embodiment, the inner sloped surface has a downward slope towards the faucet assembly. The inner sloped region 860 has a variable thickness that gradually decreases in thickness near the faucet assembly or as the inner sloped region 860 approaches the faucet assembly.

In one example, the inner sloped surface of the inner sloped region includes at least one groove or channel (e.g., V-shaped, U-shaped) for directing the liquid inside the container towards the faucet assembly even if a small volume or low level of liquid remains in the container.

Figure 9:
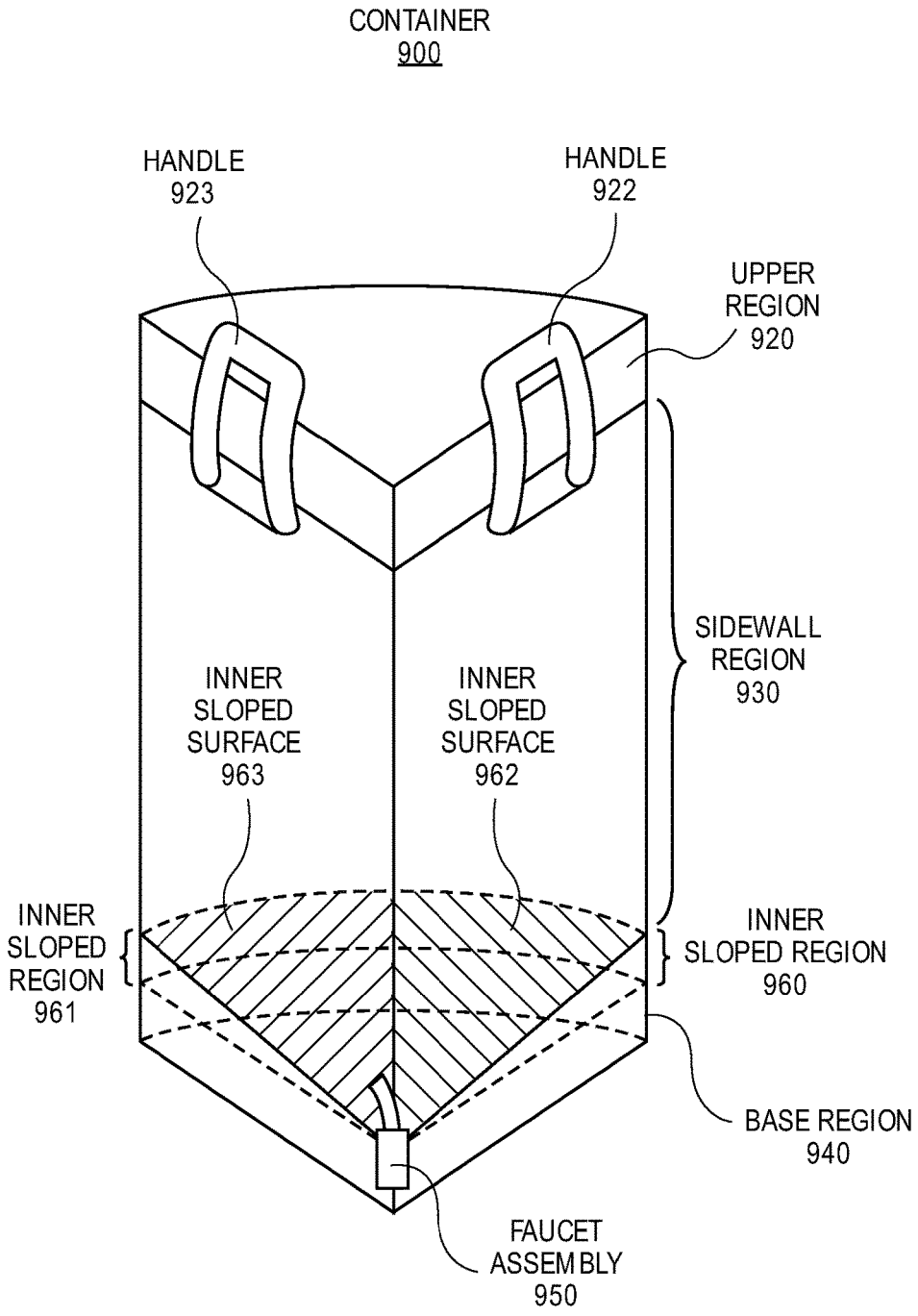
FIG. 9 illustrates a container having a base region with multiple sloped inner regions for dispensing a liquid in accordance with one embodiment.

FIG. 9 illustrates a container having a base region with multiple sloped inner regions to provide an improved ability for dispensing a liquid (or semiliquid mixture, slurry, or any fluid mixture of a pulverized solid with a liquid) in accordance with one embodiment. The container may be used for storing, insulating, cooling, and dispensing one or more liquids. The container 900 for dispensing a liquid includes an upper region 920 having an outer surface and an inner surface. A sidewall region 930 is integrated or coupled in a removable manner with the upper region 920. Handles 922 and 923 are attached to the sidewall region 930. The upper region 920 may include or be a pull off pressure fit lid. Alternatively, the upper region 920 may include a twist off lid that is removable by rotating the lid. A base region 940 is integrated or coupled in a removable manner with the sidewall region. In one example, the base region 940 is not removable, it is integrated with the sidewall region. The base region 940 includes an inner sloped region 960 having an inner sloped surface 962 and an inner sloped region 961 having an inner sloped surface 963 within the container for improving an ability of the container to dispense the liquid from the container. The inner sloped surface 962 is an upper surface of the inner sloped region 960 and the inner sloped surface 963 is an upper surface of the inner sloped region 961.

A faucet assembly 950 (e.g., spigot, dispenser) is integrated with or coupled with an opening of the base region or an opening of the sidewall region to dispense the liquid outside of the container. The inner sloped surfaces of the container provides a tip free technology that prevents the liquid (e.g., low level of liquid) from being trapped inside the container even when the faucet assembly is in an open position and the base region rests on a surface (e.g., horizontal surface) without being tilted. In one example, the inner sloped surfaces have a slope sufficient (e.g., 3 to 30 degrees, 5 to 15 degrees, 8 to 12 degrees, 10 degrees) with respect to a horizontal reference line to drain liquid from the base region of the container. The container (e.g., upper region, sidewall region, lower region) may include insulation (e.g., polyurethane insulation) for keeping ice or liquid at a lower temperature in the container in comparison to ambient temperature conditions.

Figure 10:
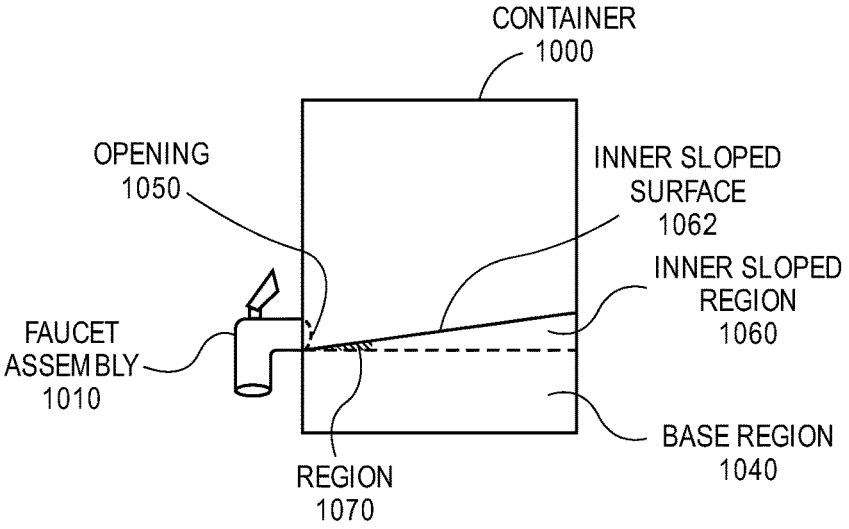
FIG. 10 illustrates a cross-sectional view of a container with an inner sloped region to provide an improved ability for dispensing a liquid in accordance with one embodiment.

FIG. 10 illustrates a cross-sectional view of a container with an inner sloped region to provide an improved ability for dispensing a liquid (or semiliquid mixture, slurry, or any fluid mixture of a pulverized solid with a liquid) in accordance with one embodiment. The container 1000 (e.g., beverage container, liquid cooler, water cooler) may be used for storing, insulating, cooling, and dispensing one or more liquids via a faucet assembly 1010. A base region 1040 includes or is integrated with an inner sloped region 1060 having an inner sloped surface 1062 within the container for improving an ability of the container to dispense the liquid (e.g., all liquid) via the faucet assembly 1010 from the container. The faucet assembly 1010 is illustrated in an open position.

In one embodiment, the inner sloped surface has a downward slope towards the faucet assembly. The inner sloped region has a variable thickness that gradually decreases in thickness near the faucet assembly or as the inner sloped region approaches the faucet assembly. A region 1070 of the inner sloped region closest or adjacent to an opening 1050 of the faucet assembly is at approximately the same height as the opening 1050 within the container. In another example, the region 1070 of the inner sloped region closest or adjacent to the opening 1050 of the faucet assembly is at approximately the same height as a lowest level or lowest edge of the opening within the container.

Figure 11:
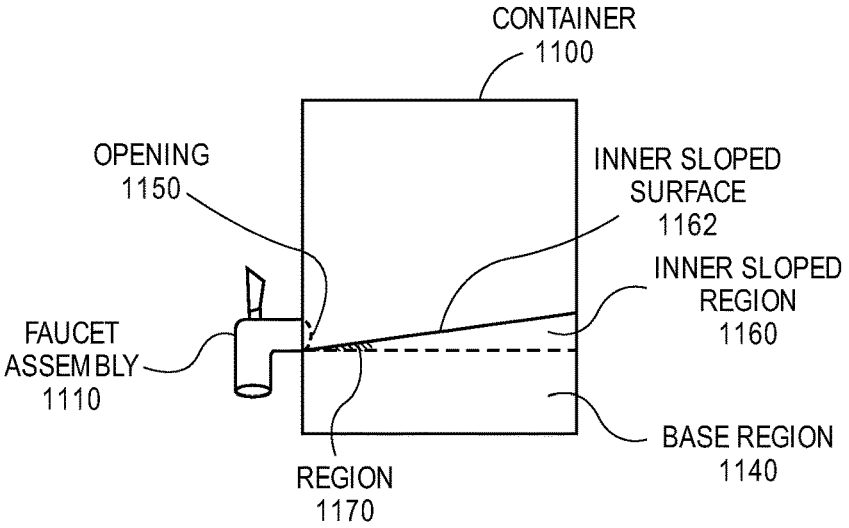
FIG. 11 illustrates a cross-sectional view of a container with an inner sloped region to provide an improved ability for dispensing a liquid in accordance with one embodiment.

FIG. 11 illustrates a cross-sectional view of a container with an inner sloped region to provide an improved ability for dispensing a liquid (or semiliquid mixture, slurry, or any fluid mixture of a pulverized solid with a liquid) in accordance with one embodiment. The container 1100 (e.g., beverage container, liquid cooler, water cooler) may be used for storing, insulating, cooling, and dispensing one or more liquids via a faucet assembly 1110. A base region 1140 includes or is integrated with an inner sloped region 1160 having an inner sloped surface 1162 within the container for improving an ability of the container to dispense the liquid (e.g., all liquid) via the faucet assembly 1110 from the container. The faucet assembly 1110 is illustrated in a closed position.

In one embodiment, the inner sloped surface has a downward slope towards the faucet assembly. The inner sloped region has a variable thickness that gradually decreases in thickness near the faucet assembly or as the inner sloped region approaches the faucet assembly. A region 1170 of the inner sloped region closest or adjacent to an opening 1150 of the faucet assembly is at approximately the same height as the opening 1150 within the container. In another example, the region 1170 of the inner sloped region closest or adjacent to the opening 1150 of the faucet assembly is at approximately the same height (or just below) as a lowest level or lowest edge of the opening within the container.

In one embodiment, a container for dispensing a liquid (or semiliquid mixture, slurry, or any fluid mixture of a pulverized solid with a liquid) includes an upper region having an outer surface and an inner surface, a sidewall region coupled or integrated with the upper region, and a lower region integrated with the sidewall region. The lower region includes an inner sloped region having an inner sloped surface within the container to provide an improved ability for dispensing the liquid from the container without having to tilt the container. In one example, the container further includes a faucet assembly integrated with the lower region or the sidewall region to dispense the liquid outside of the container. The inner sloped region having the inner sloped surface prevents the liquid from being trapped inside the container even when the faucet assembly is in an open position and the lower region rests on a surface without being tilted.

In one example, the inner sloped surface has a slope of 5 to 15 degrees with respect to a horizontal reference line.

In one embodiment, the inner sloped surface has a downward slope towards the faucet assembly. The inner sloped surface forms an upper surface of the inner sloped region of the lower region. The inner sloped region has a variable thickness that gradually decreases near the faucet assembly.

In one example, the inner sloped surface of the inner sloped region includes at least one groove or channel for directing the liquid inside the container towards the faucet assembly. The container has a cylindrical shape with the lower region supporting the sidewall region and the upper region. The container has a rectangular shape, square shape, or triangular shape with the lower region supporting the sidewall region and the upper region.

In one embodiment, a cooler for dispensing a liquid (or semiliquid mixture, slurry, or any fluid mixture of a pulverized solid with a liquid) includes an upper region to provide a lid for the cooler and being capable of being removed from the cooler, a sidewall region coupled with the upper region, and a base region integrated or coupled with the sidewall region. The base region supports the sidewall region and the upper region. The base region includes first and second inner sloped regions within the cooler for dispensing the liquid from the cooler. The cooler further includes a faucet assembly integrated with the base region or the sidewall region to dispense the liquid from the cooler.

The first and second inner sloped regions prevent the liquid from being trapped inside the container even when the faucet assembly is in an open position and the base region rests on a surface without being tilted. The first and second inner sloped regions each have a slope of 5 to 15 degrees with respect to a horizontal reference line.

In one example, the first inner sloped region has a downward slope in a first direction towards a lower inner surface of the base region and the second inner sloped region has a downward slope in a second direction towards the lower inner surface of the base region. The lower inner surface has a downward slope in a third direction towards the faucet assembly. The lower inner surface may include at least one groove or channel with a downward slope in the third direction for directing the liquid inside the cooler towards the faucet assembly.

In one embodiment, a container for dispensing a liquid (or semiliquid mixture, slurry, or any fluid mixture of a pulverized solid with a liquid) includes an upper region of the container that is capable of being removed from the container, a sidewall region integrated or coupled with the upper region, and a base region integrated or coupled with the sidewall region. The base region supports the sidewall region and the upper region. The base region includes an inner sloped region within the container for dispensing the liquid from the container. A faucet assembly is integrated with the base region or the sidewall region to dispense the liquid from the container. The inner sloped region prevents the liquid from being trapped inside the container even when the faucet assembly is in an open position and the base region rests on a horizontal surface without being tilted.

In one example, the inner sloped region has a slope of 3 to 30 degrees with respect to a horizontal reference line. The inner sloped region has a downward slope towards the faucet assembly. The lower inner surface may include at least one groove or channel with a downward slope for directing the liquid inside the container towards the faucet assembly.

It is to be understood that the above description is intended to be illustrative, and not restrictive. Many other embodiments will be apparent to those of skill in the art upon reading and understanding the above description. The scope of the invention should, therefore, be determined with reference to the appended claims, along with the full scope of equivalents to which such claims are entitled.

What is claimed is:

1. A beverage cooler for dispensing a liquid, comprising:

an upper region to provide a lid for the beverage cooler and being capable of being removed from the beverage cooler;

a sidewall region coupled with the upper region; and a base region integrated or coupled with the sidewall region, wherein the base region includes a solid flat bottom base support to support the sidewall region and the upper region, wherein the solid flat bottom base region is integrated with the sidewall region, wherein the base region includes first and second inner sloped regions positioned above the solid flat bottom base support, the first and second inner sloped regions having upper planar surfaces in contact with the liquid if sufficient liquid exists within the beverage cooler, wherein the first inner sloped region has a downward slope in a first direction towards a lower inner surface of the base region, wherein the second inner sloped region has a downward slope in a second direction towards the lower inner surface of the base region that is positioned above the solid flat bottom base support and the lower inner surface has a downward slope in a third direction along a length with a width of 0.2 inches to 3 inches, wherein the base region includes thermal insulation for thermal insulating of the liquid, wherein the first and second inner sloped regions have upper surfaces with a slope of 20 to 30 degrees with respect to a horizontal reference line for a width of each of the first and second inner sloped regions.

2. The cooler of claim 1, further comprising:

a faucet assembly integrated with the base region or the sidewall region to dispense the liquid, semiliquid mixture, slurry, or any fluid mixture of a pulverized solid with a liquid from the cooler.

3. The cooler of claim 1, wherein the first and second inner sloped regions to prevent the liquid from being trapped inside the container when the faucet assembly is in an open position and the base region rests on a surface without being tilted.

4. The cooler of claim 1, wherein the base region is integrated with the sidewall region and the upper region.

5. The cooler of claim 1, wherein the lower inner surface has a downward slope in a third direction towards the faucet.

6. The cooler of claim 1, wherein the lower inner surface includes at least one groove or channel with a downward slope in the third direction for directing the liquid inside the cooler towards the faucet assembly.

7. A beverage container for dispensing a liquid, comprising:

an upper region of the beverage container that is capable of being removed from the beverage container;

a sidewall region integrated or coupled with the upper region; and a solid flat bottom base region integrated with the sidewall region, wherein the base region supports the sidewall region and the upper region, wherein the base region includes an inner sloped region within the container for dispensing the liquid from the container, wherein an upper surface of the inner sloped region includes an exposed recessed channel having an annular region near a center of the upper surface of the inner sloped region and a linear region between the annular region and a faucet assembly region, wherein the annular region is integrated with the linear region to form the recessed channel of the upper surface of the inner sloped region, wherein the recessed channel includes multiple sub-channels for directing the liquid towards a faucet assembly.

8. The container of claim 7, wherein the faucet assembly is integrated with the base region or the sidewall region to dispense the liquid from the container.

9. The container of claim 7, wherein the inner sloped region to prevent the liquid from being trapped inside the container when the faucet assembly is in an open position and the base region rests on a horizontal surface without being tilted.

10. The container of claim 7, wherein the base region is integrated with the sidewall region and the upper region.

11. The container of claim 10, wherein the inner sloped region has a downward slope towards the faucet assembly.

12. The container of claim 11, wherein the lower inner surface includes at least one groove or channel with a downward slope for directing the liquid inside the container towards the faucet assembly.

* * * * *